United States Patent [19]

Oppawsky

[11] Patent Number: 4,988,883

[45] Date of Patent: Jan. 29, 1991

[54] FINGERNAIL PHOTOPOLYMERIZATION APPARATUS

[75] Inventor: Steffen Oppawsky, Bad Homburg, Fed. Rep. of Germany

[73] Assignee: Heraeus Kulzer GmbH, Hanau am Main, Fed. Rep. of Germany

[21] Appl. No.: 378,633

[22] Filed: Jul. 12, 1989

[30] Foreign Application Priority Data

Jul. 26, 1988 [DE] Fed. Rep. of Germany ..... 3825324

[51] Int. Cl.[5] ..... G21K 5/08

[52] U.S. Cl. ..... 250/492.1; 250/455.1; 250/504 R

[58] Field of Search ..... 250/492.1, 504 R, 455.1; 132/73

[56] References Cited

U.S. PATENT DOCUMENTS

| | | | |
|---|---|---|---|
| 4,148,934 | 4/1979 | Baker | 250/504 R |
| 4,612,444 | 9/1986 | Ragusa | 250/492.1 |
| 4,731,541 | 3/1988 | Shoemaker | 250/492.1 |
| 4,754,769 | 7/1988 | Flynn | 132/73.5 |
| 4,864,145 | 9/1989 | Bsurgio, Jr. | 250/492.1 |

FOREIGN PATENT DOCUMENTS

| | | |
|---|---|---|
| 8513789 | 12/1985 | Fed. Rep. of Germany . |
| 8609293 | 7/1986 | Fed. Rep. of Germany . |

OTHER PUBLICATIONS

"Tami Nail Light System Lichthärtendes Gel-System Für Die Fingernägel-Kosmetik", (Tami Nail Light System, Photohardening Gel Systems for Cosmetic Fingernails.

*Primary Examiner*—Jack I. Berman
*Assistant Examiner*—Kiet T. Nguyen
*Attorney, Agent, or Firm*—Frishauf, Holtz, Goodman & Woodward

[57] ABSTRACT

Fingernail light systems for curing photopolymerizable plastics on fingernails are known, having a housing with a bottom plate 7, in which housing a support body 4, having indentations 18 on its outer contour, is provided for positioning the fingers of the hand 5 to be irradiated, and having at least one irradiation lamp 14, which at least partially surrounds the support body in a spaced-apart manner in the irradiation position, the support body being accessible in the irradiation position via an opening 10 in the housing. In order to provide a system that meets the indicated needs and assures a uniform irradiation of all the fingernails of both the left and the right hand, with the light originating in the irradiation lamp substantially striking the fingernails (20–24) to be cured, in which fingernails of even great length can be irradiated and a comfortable hand posture can be maintained, even over a relatively long period on the order of half a minute, the support body 4 of the present invention features an approximately cylindrical (FIG. 1) or frusto-conical (FIG. 3) outer contour, at least in the vicinity of the indentations, and the indentations are in the form of channels 18 that extend substantially in the direction of the axis of the support body, and the axis 3 of the support body 4 forms an angle in the range from 0° to 90° with the direction 31 orthogonal to bottom plate 7.

17 Claims, 3 Drawing Sheets

FINGERNAIL PHOTOPOLYMERIZATION APPARATUS

Cross-reference to related application, assigned to the assignee of the present invention: OPPAWSKY & BURCKHARDT, U.S. Ser. No. 07/378,636, filed July 12, 1989.

The invention relates to a fingernail light system for curing photopolymerizable plastics on fingernails, having a housing with a bottom plate, in which housing a support body, with grooves or indentations on its outer contour, is provided for positioning the fingers of the hand to be irradiated, and having at least one irradiation lamp at least partially surrounding the support body in a spaced-apart manner in the irradiation position. The support body is accessible in the irradiation position via an opening in the housing.

BACKGROUND

A fingernail light system of this kind is known from U.S. Pat. No. 4,731,541, SHOEMAKER/CONAIR. This system has a column-like support arm 5, which can be secured for instance to a tabletop with a clamping screw 7. A housing 3 of circular outer contour is located on the end of this support arm 5.

On its underside, that is, the side oriented toward the tabletop or bottom plate of the support arm, the housing 3 has an introduction opening 11 into which a plate-like support body or handle 15, centrally secured on a telescoping shaft 14, is movable and from which it can be removed. An annular irradiation lamp 21, defining a closed circle, is secured in the housing, centered on telescoping shaft 14. The support body or handle 15, which is quite flat, in the form of a plate, has notches or grooves 17 on its outer periphery that serve to position a hand grasping the plate 15. For irradiating the fingernails, the hand grips the periphery of the support body from below, in such a way that the end joints of the fingers rest on the top of the support body, as shown in FIGS. 6 and 7 of the patent. In this position, the fingernails are horizontally aligned, and point in the direction of the support arm or shaft 14 located in the center of the plate. Depending on the length of the fingernails, the fingernails extend as far as the support arm 14. The plate 15 grasped in this way is then moved into the housing into an upper position, guided on the support arm 14. The radiation emitted by the irradiation lamp 21, which extends with its axis slightly above the top of the support plate 15, is reflected by the upper region 25 of the housing 3 and an additional reflector 27 onto the fingers and onto the fingernails that are to be cured. Once the irradiation is finished, the plate 15 can be pulled downward back out of the housing again.

Another design for a fingernail light system is known from German Utility Model DE-GM No. 85 13 789, NK-OPTIK GmbH. This system has a support plate with a plurality of low-pressure fluorescent tubes (*2a–2f*) that extend parallel to one another in the direction of the longitudinal axis of the housing and form a tunnel.

Technical Bulletin No. 7070, entitled "LEE UV NAILS", of Lee Pharmaceuticals, in South El Monte, California, published in 1975, describes another light system for curing artificial nail replacements; in its basic concept, it is similar in design to the system of German Utility Model DE-GM No. 85 13 789. In this system, the hand that is to be irradiated is thrust under the light source through a slit in the housing wall.

Another system for curing photocuring plastics on fingernails is known from German Utility Model DE-GM No. 86 09 293, Desonic-Kunststoff GmbH. This system is equipped with a plurality of elongated UV light sources, in a particular embodiment being four in number, arranged to form a tunnel; in its structure, this system is identical to the system known from German Utility Model DE-GM No. 85 13 789. The housing of this system can be pivoted upward about a horizontal rear axis 3.

Finally, the advertising brochure entitled "TAMI NAIL LIGHT SYSTEM LICHTHÄRTENDES CEL-SYSTEM FÜR DIE FINGERNAGELKOSMETIK" ["TAMI NAIL LIGHT SYSTEM, PHOTOHARDENING GEL SYSTEMS FOR COSMETIC FINGERNAILS"] of the firm of TAMARA KOSMETIK, 8000 Munich, Federal Republic of Germany, shows a light system that in its external design is equivalent to the system of German Utility Model DE-GM No. 86 09 293.

The above-discussed systems are required in order to cure what are known as tips, which are placed on short or broken-off fingernails and coated with UV-hardening plastics. For an artificial fingernail, tips up to 5 cm in length are used. The emplaced tip, which ends on top of a natural fingernail, must be coated afterward to equalize the levels of the tip and the nail. In this process, a plastic composition is repeatedly applied and repeatedly cured. Only after the emplaced fingernails have been coated are they shortened to the desired length and, normally, polished.

THE INVENTION

It is an object of the present invention, based on a light system as described above, to provide a system that meets the indicated needs and assures uniform irradiation of all the fingernails of both the left and the right hand, in which the light originating in the irradiation lamp substantially strikes the fingernails to be cured, in which fingernails of great length can also be irradiated, and in which, during the irradiation, a comfortable hand posture is provided that can be maintained even for a relatively long period on the order of half a minute.

Briefly, this object is achieved by forming the support body with an approximately cylindrical or frusto-conical outer contour, at least in the vicinity of the grooves. The grooves are in the form of channels that extend substantially in the direction of the axis of the support body, and the axis of the support body forms an angle in the range from 0° to 90° with the direction orthogonal to the bottom plate. Because the fingers of the hand to be irradiated are laid on the outside of this cylindrical or frustoconical support body, the directions orthogonal to the respective fingernails, to be irradiated, are aligned approximately radially to the axis of the support body. Thus, sufficient space is available to position even very long fingernails in such a way that they do not touch any part of the housing or other parts, since they are aligned parallel to the axis.

Besides the grooves in the form of elongated channels, which form a large support area for the various fingers, a preferred embodiment has stops for the fingertips, in order to position the various fingers at the correct point on the support body. Preferably, such stops are located on the lower end of the support body, that is, the end toward the bottom plate, so that the fingernails to be irradiated will protrude freely beyond the end of the support body, which may for instance be held by a telescoping rod.

Since the support body is accessible via an opening on the top of the housing, the hand to be irradiated can be placed on the support body in an extremely comfortable and relaxed posture. In a simple geometric embodiment of the support body in the form of a cylinder or truncated cone, with an annular irradiation lamp that surrounds the support body, equal spacing of the various fingernails of both the left and the right hand with respect to the irradiation lamp, and hence a uniform curing of the plastics to be polymerized, are achieved.

The axis of the support body should either be aligned vertically to the bottom plate or form an angle of a maximum of 90° to the direction orthogonal to the bottom plate; the selection of the angle depends on the height of the table on which the system is placed, among other factors. The preferred angle that the axis of the support body forms with the area normal of the bottom plate is in the range from 0° to 60°, so that the hand can be placed onto the support body vertically or obliquely from above.

The channels of the support body are symmetrical to a first plane extending through the axis of the support body and in the direction of the arm of a hand to be placed on the support body, so that equal irradiation of the fingernails of a left and right hand placed on the support body is assured. To limit the number of channels required, only one channel is provided for the middle fingers of the left and right hand; this channel extends in the region of the first plane, and thus is located out of sight of the person placing his hand on the support body, on the side of the support body opposite the seated position of that person. The channels for the little fingers of the left and right hand are preferably positioned approximately along the second plane, which extends through the axis of the support body and is vertical to the first plane; that is, the channels are offset from one another by an angle of 180°.

The channels for the little fingers, in an advantageous feature of the invention, are located on a raised portion of the support body, in such a way that the finger nails of the little finger are located outside the shadow of the ring finger. This kind of provision may be necessary since the fingernails of the little fingers, in constrast to the fingernails of the thumbs, index fingers, middle fingers and ring fingers, have a slightly twisted alignment and depending on the diameter of the support body may be adequately irradiated only if the positioning channels are located on a raised portion. This means that the support body, seen in cross section, deviates from a circular outer contour and is curved outward at the point where the channels for the little fingers are located.

The channels should be distributed over a maximum angle range of 320° to 360° over the circumference of the support body, so that the base of the irradiation lamp, or if an annular irradiation lamp is for instance divided into two arc-shaped lamps, the bases of a plurality of irradiation lamps, can be located in the zone of the remaining angular range of from 40° to 60°. To enable simple and accurate positioning of the hand on the support body, the support body should be movable axially inward and outward. Preferably, the support body is held out of its upper position, that is, its position retracted from the housing, by springs, which are selected such that the weight of the hand placed on the support body is capable of thrusting the support body into the housing. Once the irradiation process is completed, the support body is removed from the housing once again by slightly lifting the hand.

To provide additional support for the hand, the periphery of the housing opening can merge with a support on which the forearm of the hand to be irradiated rests.

As additional protection against glare, the housing opening can be partly covered by a hinged glare protection shade.

An end switch, which is actuated upon lowering of the support body into the housing, can switch the system on and off.

For geometric simplicity of the lamp, in particular with lamps having a straight axis that are available on the market, the circle or circular segment, over which the irradiation lamps are to extend, can be approximated by means of 3 to 4 irradiation lamps having a straight-line lamp axis.

DRAWINGS

Exemplary embodiments of the invention will now be described in further detail, referring to the drawings.

DETAILED DESCRIPTION

Figure 1:
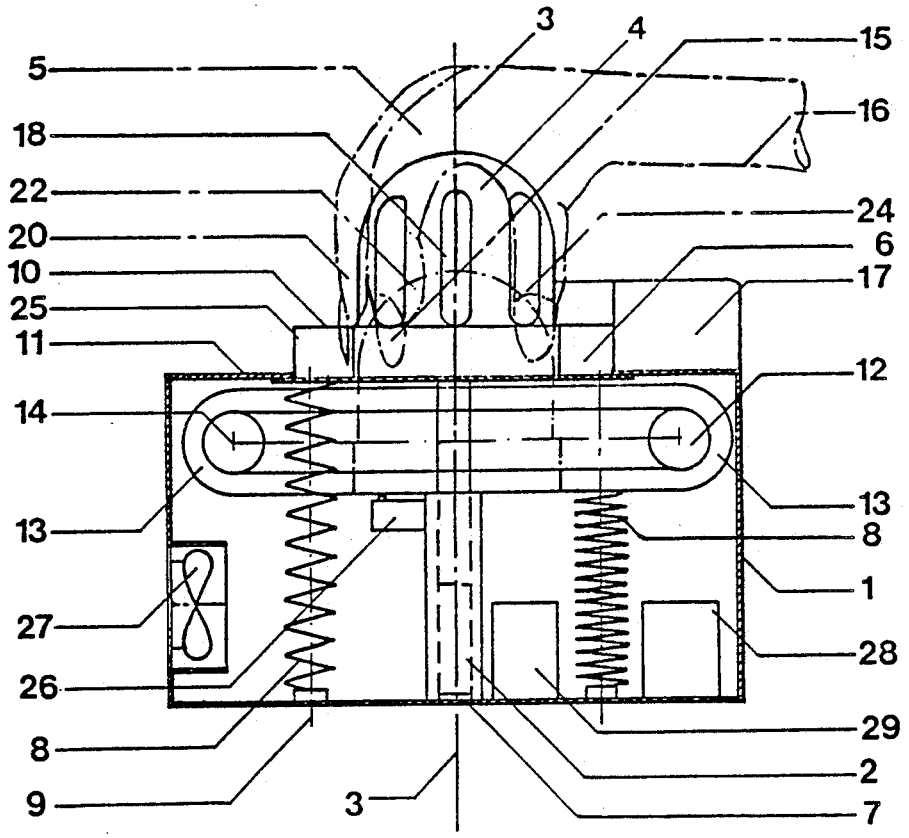
FIG. 1 is a longitudinal section through a light system having a vertically extending axis of the support body, in a position in which it is retracted from the system.

The fingernail light system has a housing 1, in the center of which a telescoping arm 2 having a vertically aligned axis 3 is located. A support body 4 is secured to the upper end of the telescoping arm, and on it a hand, indicated by dot-dash lines, is placed in such a way that it grasps the support body 4 from above. A support frame 6 is also secured to the upper end of the telescoping arm 2, and two spiral springs 8 engaging the bottom plate 7 of the housing 1 are located on the underside of the support frame 6, with their axes 9 extending parallel to the axis 3 of telescoping arm 2.

The spring 8 on the left in FIG. 1 is shown in a position in which the support body 4 is retracted from the housing 1 via an upper housing opening 10 via the telescoping arm 2, while the spiral spring 8 on the right is shown compressed, in a position in which the support body 4 has been thrust into the housing 1. Located beneath the upper housing cover 11 is an annular irradiation lamp 12 surrounded by a reflector 13. The axis 14 of the irradiation lamp 12 extends horizontally, that is, at a right angle to the axis 3 of telescoping arm 2.

Figure 2:
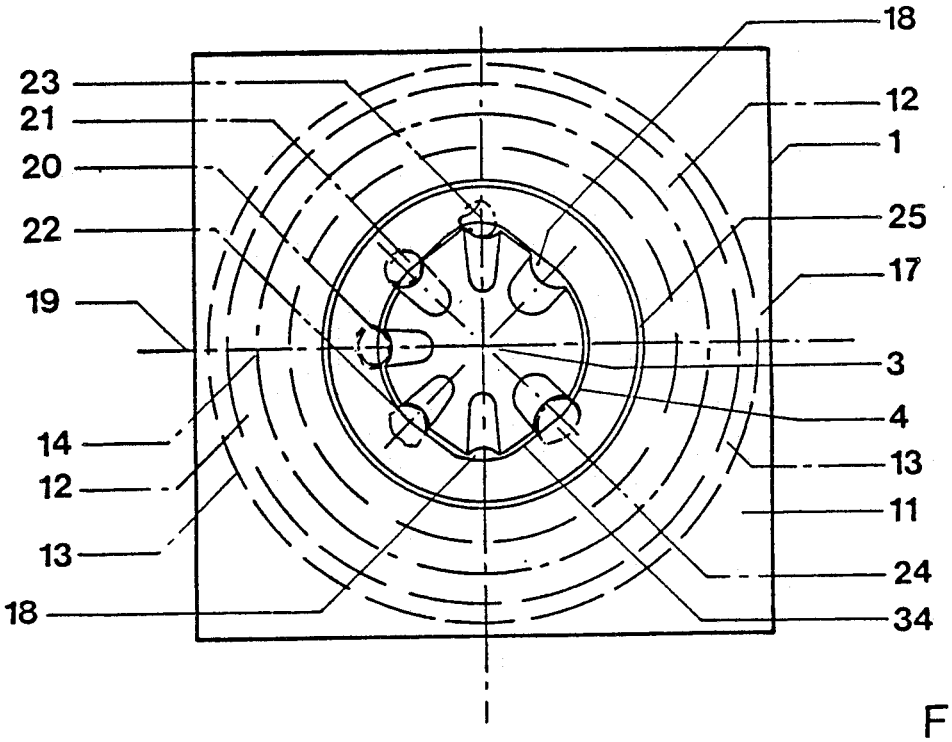
FIG. 2 is a plan view of the light system of FIG. 1.

As FIG. 2 also shows, the irradiation lamp 12 and the reflector 10 both extend concentrically to the axis 3 of the telescoping arm 2, which simultaneously forms the axis of the support body 4 as well.

In its upper position, the support body 4 is readily accessible; the lower position, represented by the dot-dash line, is selected so that the fingernails 15 are positioned in the irradiation zone of the irradiation lamp 12, which is limited by the reflectors 13 to a narrow annular sector. In the lower position, the forearm 16 rests on a support 17 that merges with the edge of the housing opening 10, which assures a relaxed hand posture during irradiation of the fingernails 15 in the housing 1.

Figure 3:
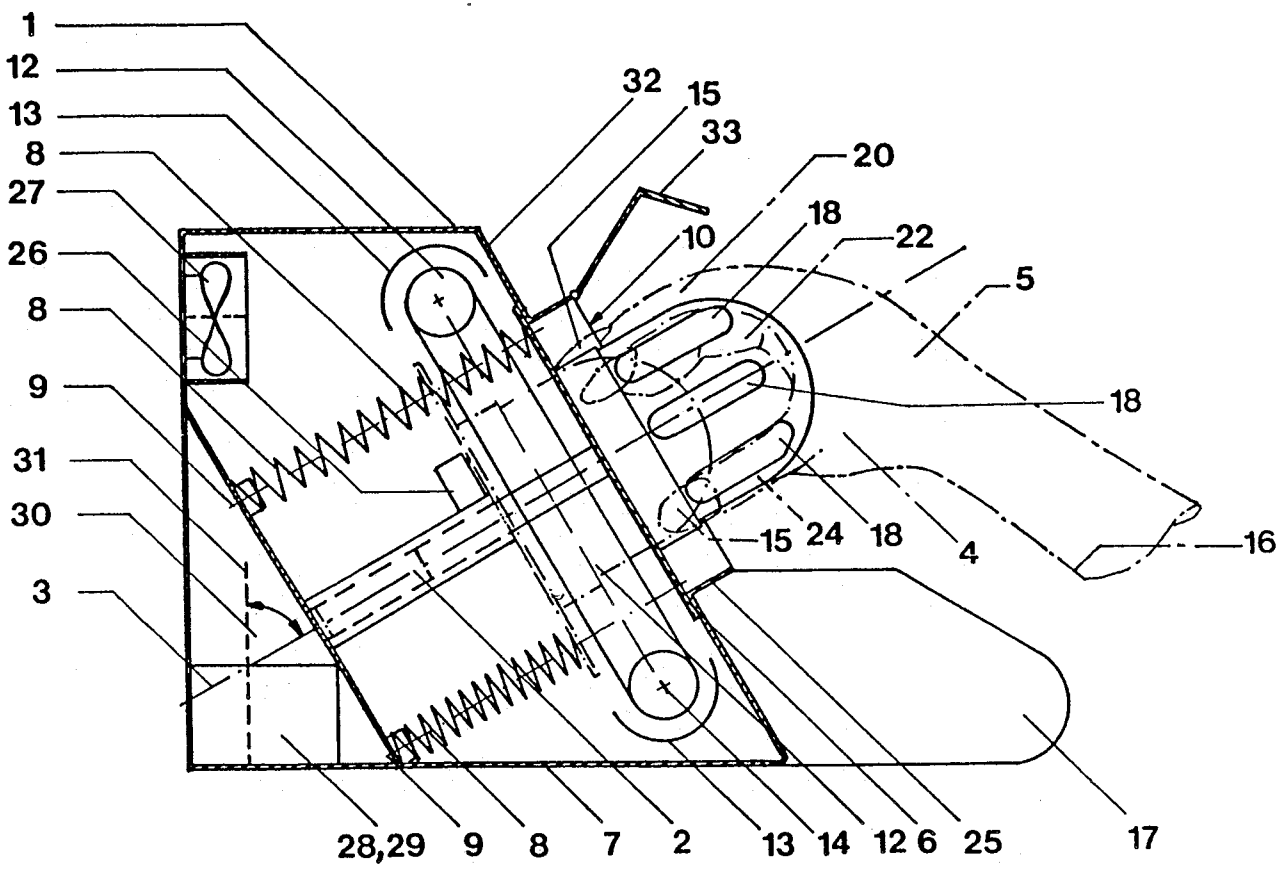
FIG. 3 shows an embodiment of a light system similar in design to the embodiment of FIG. 1, with the axis of the support body extending obliquely or diagonally.

The support body 4, has a generally convex surface and, in FIGS. 1–3 has an approximately cylindrical outer contour, has a plurality of channels 18, which extend axially and have a depth in the vicinity of the groove bottom of approximately 2 to 5 mm. There is a total of seven channels, as shown clearly in FIG. 2, distributed about the outer circumference of support body 4; the middle channel, which coincides with the first plane 19, serves to position the middle finger 20 of either a left or a right hand 5. This channel 18 for the middle finger 20 is exactly opposite the seated position of the person whose fingernails are to be irradiated. Two further channels 18 are offset by approximately 45° with respect to the channel 18 for the middle finger 20, and they serve to receive the ring finger 21 and index finger 22, for instance of a right hand as in FIG. 2; when the fingernails of a left hand are irradiated, the channel 18 for the ring finger 21 is then used for the index finger instead, while the channel 18 for the index finger now serves to receive the ring finger. Two further channels 18 are located offset to the channel for the index finger or ring finger 21, 22 by 90°; they serve to receive the little finger 23 of a hand to be irradiated. Of the channels 18, one channel 18 each is definitively associated with the little finger of a right hand and the little finger of a left hand. Finally, two channels 18 for the thumbs 24 of a left and a right hand are provided, which are offset by an angle of approximately 135° to both sides with respect to the channel 18 for index finger 22.

To avoid blinding the person being treated, the housing opening 10 is surrounded by a continuous glare protection rim 25. In the lower position of the support body 4, its underside actuates an end switch 26 (see FIG. 1), in order to put the irradiation lamp 12, as well as further systems, such as a fan 27 located laterally in the housing 1, into operation. In the lower portion of the housing 1, next to the fan 27, there is also sufficient room for power supply parts 28 and chokes 29.

By comparison with the version of FIG. 1, in the FIG. 3 embodiment of the light system, the axis 3 of the telescoping arm 2 and support body 4 extends at an angle 30 of about 45° to the orthogonal axis 31, represented by the broken line, of the bottom plate 7. The entire light system, formed by the irradiation lamp 12, the reflector 13 surrounding irradiation lamp 12, and the spiral springs 8, is correspondingly tilted. The axis 14 of the irradiation lamp 12 is again aligned at an angle of 90° with respect to the axis 3 of telescoping arm 2 and support body 4, as in the version of FIG. 1. The housing opening 10 is located in a front housing panel 32, so that the hand 5 rests from the front on the support body 4, and the fingers can be positioned in the channels 18. The support 17 for the forearm 16 is an extension of the lower rim of the housing opening 10, which simultaneously forms the glare protection rim 25. A hinged glare protection hood 33 is also secured to the upper part of the glare protection rim 25. The glare protection hood 33 can be folded over the back of the hand, once the hand 5 along with the support body 4 has been moved into the housing 1.

Figure 4:
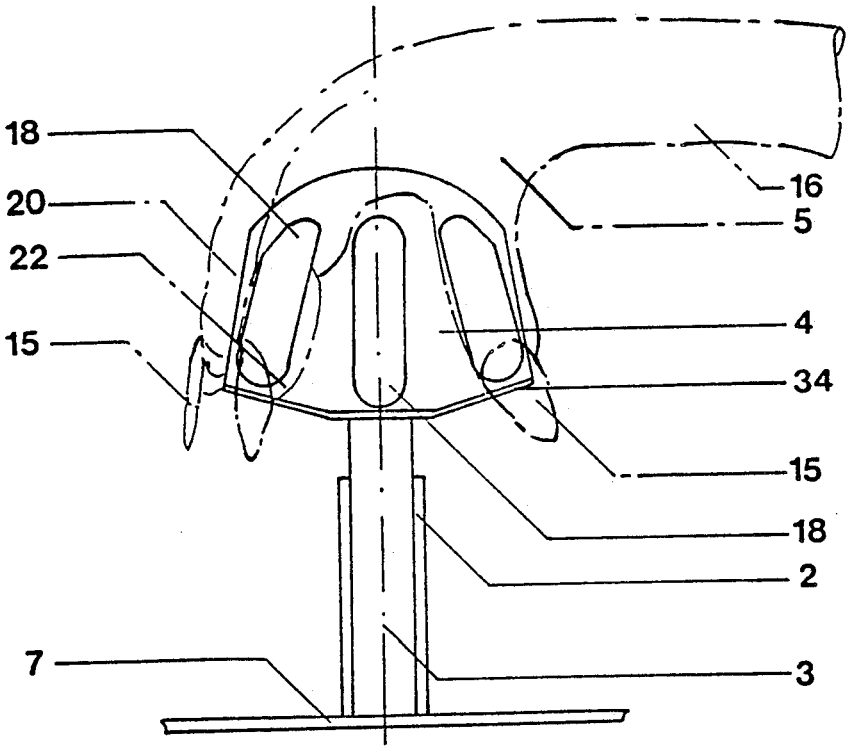
FIG. 4 shows a frusto-conical support body.

In FIGS. 1–3, a support body 4 of approximately cylindrical outer contour is used. FIG. 4 shows a support body 4 formed as a truncated cone. This support body 4 is again rounded on top, to form a rest for the palm of the hand 5. The fingernails 15 of the fingers placed in the channels 18 protrude past the lower rim of the support body 4, so that they do not touch any part of the light system, and can be freely irradiated from all sides. Besides the channels 18 as positioning means for the various fingers, an additional positioning means can be used in the form of stops or an encompassing bead 34, against which the fingertips of the hand 5 placed on the support body 4 come to rest.

Figure 5:
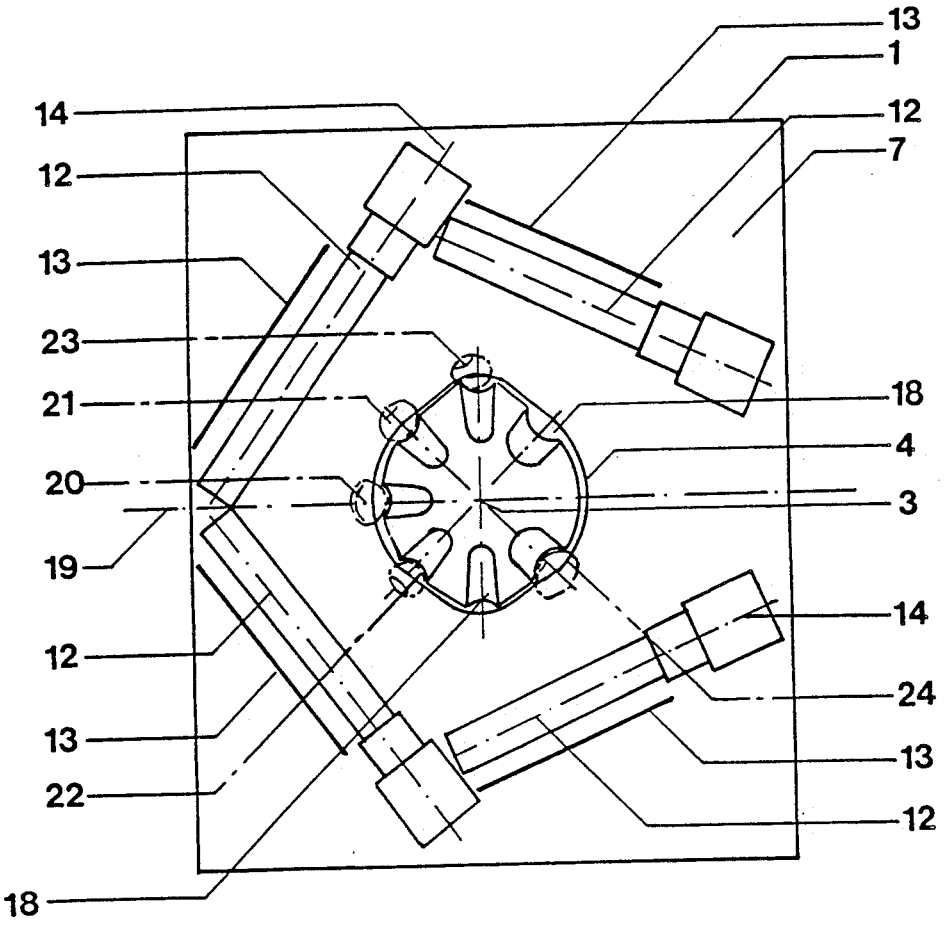
FIG. 5 is a plan view, corresponding to FIG. 2, in which, by comparison with FIG. 2, the annular irradiation lamp is replaced by four individual irradiation lamps, drawn schematically so that they are visible.

FIG. 5 illustrates an embodiment similar to that of FIGS. 1 and 2, with the axis 3 of the support body 4 again oriented vertically with respect to the bottom plate 7. However, the support body 4 is surrounded by four separate irradiation lamps 12, each having a straight lamp axis 14. These straight irradiation lamps 12 are lined up with one another in such a way that they form an approximate circle about the support body 4, at least over the circumference over which the various channels 18 for the fingers are distributed. This circle need not be closed, because the irradiation zone begins at the channel 18 for one thumb 24 and ends with the channel 18 for the other thumb 24, so that an irradiation zone of only 300° to approximately 320° is required. The irradiation lamps 12 shown in FIG. 5 are again surrounded by reflectors 13, which aim the light at the support body 4, and in particular at the lower region thereof.

Various changes and modifications may be made, and features described in connection with any one of the embodiments may be used with any of the others, within the scope of the inventive concept.

What is claimed is:

1. A fingernail light system for curing photo-polymerizable plastics on fingernails, having a housing (1) with a bottom plate (7) in which housing there is provided a support body (4), having indentations (18) on its outer contour, for positioning fingers (20–24) of a hand to be irradiated, and having at least one irradiation lamp (14), which at least partially surrounds the support body in a spaced-apart manner in an irradiation position, the support body being accessible in the irradiation position via an opening (10) formed in the housing (1), and wherein, the support body (4) has a generally convex outer contour, defining a central palm-support surface with said indentations radiating therefrom, said indentations defining channels (18) that extend substantially in the direction of a longitudinal axis (3) of the support body (4), and positively position fingers placed therein, and the axis (3) of the support body (4) forms an angle (30) in the range from 0° to 90° with the direction (31) orthogonal to the bottom plate (7).

2. A fingernail light system according to claim 1, wherein the axis (3) of the support body (4) forms an angle (30) in the range from 0° to 60° with the direction (31) orthogonal to the bottom plate (7).

3. A fingernail light system according to claim 1, wherein the channels (18) of the support body (4) are located symmetrically with respect to a first plane (19) extending through the axis (3) of the support body (4) and in the direction of the arm (16) of a hand (5) to be placed on the support body (4).

4. A fingernail light system according to claim 3, wherein the channel (18) associated with the middle finger (20) extends in the vicinity of the first plane (19).

5. A fingernail light system according to claim 3, wherein the support body (4) has one channel (18) each for the little finger (23) of the left and right hand, which channels extends approximately along a second plane extending through the axis (3) of the support body (4) and vertically to the first plane (19).

6. A fingernail light system according to claim 1, wherein the channels (18) for the little fingers (23) are on a raised portion of the support body, in such a way that the finger nails (15) of the little fingers (23) are positioned outside the shadow of the ring finger.

7. A fingernail light system according to claim 1, wherein that two channels (18) are provided for the thumbs (24), two channels (18) are provided for the ring fingers (21) and two channels (18) are provided for the index fingers (22).

8. A fingernail light system according to claim 7, wherein the channels (18) are distributed about the circumference of the support body (4) over an angular range extending approximately 300° to 320° about said circumference.

9. A fingernail light system according to claim 1, wherein the support body (4) is located movable in the direction of its axis (3) into and out of the housing (1).

10. A fingernail light system according to claim 9, wherein the support body (4) is located such that it is displaceable counter to the force of at least one spring (8).

11. A fingernail light system according to claim 9, wherein the rim of the housing opening (10) merges with a support (17), which is located on the housing (1) opposite the channel (18) for the index finger (22) of the support body (4).

12. A fingernail light system according to claim 1, wherein the housing opening (10) is at least partly closeable by means of a hinged glare protection hood (33).

13. A fingernail light system according to claim 1, wherein the support body (4), at least in the region of the channels (18), has positioning means in the form of stops (34) against which the fingertips of the hand (5) to be irradiated rest.

14. A fingernail light system according to claim 13, wherein the stops (34) are located at the lower rim, oriented toward the bottom plate (7), of the support body (4).

15. A fingernail light system according to claim 9, wherein an end switch (26) is provided, which is actuated for operation of the system upon introduction of the support body (4) into the housing (1).

16. A fingernail light system according to claim 1, wherein the at least one irradiation lamp (12) approximately describes a circle or a circular segment.

17. A fingernail light system according to claim 16, wherein the circle or the circular segment is approximated by means of a plurality of elongated irradiation lamps (12) having a straight lamp axis (14).

* * * * *